US008613779B2

(12) United States Patent
Valldeperas-Morell et al.

(10) Patent No.: US 8,613,779 B2
(45) Date of Patent: Dec. 24, 2013

(54) TEXTILE DYEING PROCESS OF CELLULOSIC FIBERS AND THEIR BLENDS AND POLYESTER AND ITS BLENDS WITH RECYCLED DYEING BATHS

(75) Inventors: Jose Valldeperas-Morell, Terrassa (ES); Manuel Jose Lis-Arias, Terrassa (ES); Juan Antonio Navarro-Viciana, Terrassa (ES)

(73) Assignees: Golden Quimica do Brasil LTDA, Sao Paulo (BR); Jose Valldeperas-Morell, Terrassa (ES); Manuel Jose Lis-Arias, Terrassa (ES); Juan Antonio Navarro-Viciana, Terrassa (ES)

( * ) Notice: Subject to any disclaimer, the term of this patent is extended or adjusted under 35 U.S.C. 154(b) by 25 days.

(21) Appl. No.: 12/997,332

(22) PCT Filed: Mar. 27, 2009

(86) PCT No.: PCT/BR2009/000084

§ 371 (c)(1),
(2), (4) Date: Dec. 10, 2010

(87) PCT Pub. No.: WO2010/017606

PCT Pub. Date: Feb. 18, 2010

(65) Prior Publication Data

US 2011/0083283 A1 Apr. 14, 2011

(30) Foreign Application Priority Data

Aug. 11, 2008 (BR) ..... 0804658

(51) Int. Cl.

| | |
|---|---|
| ***C09B 67/54*** | (2006.01) |
| ***D06P 5/00*** | (2006.01) |
| ***D06P 1/16*** | (2006.01) |
| ***D06P 1/38*** | (2006.01) |

(52) U.S. Cl.
USPC ..... 8/440; 8/400; 8/918; 8/922; 8/101; 8/636

(58) Field of Classification Search
USPC ..... 8/440, 918, 924, 922, 400, 101, 636
See application file for complete search history.

(56) References Cited

U.S. PATENT DOCUMENTS

| | | | | | |
|---|---|---|---|---|---|
| 4,169,705 | A | * | 10/1979 | Boyd et al. | 8/532 |
| 4,715,863 | A | | 12/1987 | Navratil et al. | |
| 4,886,518 | A | * | 12/1989 | Sire | 8/566 |
| 5,426,803 | A | | 6/1995 | Hamann | |
| 6,056,790 | A | | 5/2000 | Clark et al. | |
| 6,117,192 | A | * | 9/2000 | Tate | 8/611 |
| 2006/0288497 | A1 | * | 12/2006 | Schollian | 8/536 |

FOREIGN PATENT DOCUMENTS

| | | | |
|---|---|---|---|
| DE | 4207480 | * | 3/1992 |
| GB | 1 404 545 A | | 9/1975 |

OTHER PUBLICATIONS

Translation from espasnet website oof DE 4207480 Mar. 26, 2012.*
International Search Report: PCT/BR2009/000084.

* cited by examiner

*Primary Examiner* — Lorna M Douyon
*Assistant Examiner* — Amina Khan
(74) *Attorney, Agent, or Firm* — Ladas & Parry LLP

(57) ABSTRACT

A textile dyeing process for dyeing cellulosic fibers and polyester and their respective blends with other fibers in recycled dyeing baths without carrying out any intermediate depuration treatment and using reactive and direct dyes for the cellulosic fibers and dispense dyes for polyester is described. The process recycles both the water already used in a previous dyeing cycle and all added products that have not been absorbed by the textile substrate, as well as the rest of the disperse dyes that had not been depleted in the previous dyeing cycles.

19 Claims, No Drawings

TEXTILE DYEING PROCESS OF CELLULOSIC FIBERS AND THEIR BLENDS AND POLYESTER AND ITS BLENDS WITH RECYCLED DYEING BATHS

TECHNICAL FIELD

The present request of invention patent deals with a textile dying process of cellulosic fibers in recycled dye baths without performing any intermediate depuration treatment, with reactive and direct dyes for the cellulosic fibers and disperse dyes for polyester, recycling both the water already used in a previous dying as well as all products that have been added and have not been absorbed by the textile substrate, in addition to the remains of disperse dyes that have not been depleted in the previous dying.

FOUNDATIONS OF THE TECHNIQUE

Any dying process, such as those carried out until now, requires an aqueous bath in a ratio between 5 L and 20 L per Kg of textile substrate, to which a number of auxiliary products are added (humectants, sliders, dispersers, etc.) of an organic nature and other compounds (neutral salts, acids and alkalis), which are not consumed during the dying process, or consumed only partially, besides the dyes: disperse for polyester and direct for cellulosic fibers that deplete themselves between 90% to 99% and also reactive ones also for cellulosic fibers, with a yield ranging from 60% to 90%, even if in this case the residual dye it not apt for a later dying of the same cellulosic fibers, since 10% to 40% of dye remains in its non-reactive, hydrolyzed form.

Due to a reduction in the availability of water for industrial processes, with a progressive cost increase, both in impounding and in softening and decalcifying and depuration for its discharge or recycling, for reasons of environmental protection it is necessary to consider all technical possibilities of treating water as still another reagent in the process and to look for more appropriate conditions for its direct recycling, as well as to its use and the use of all the other auxiliary products and other compounds that are not spent in the dying process. This is so because, besides cutting down on their needs and consumption, it allows a resulting advantage regarding the current depuration system for the discharge of residual waters, since only biodegradable or flocculable products can be extracted from residual waters by secondary treatments (physico-chemical or biological) whereas soluble sodium salts may be extracted only through inverted osmosis. The latter has a price tag unattractive for the industry at this moment and yields brine as a byproduct in a volume from 30% to 40%, which can be discarded only through discharge into the oceans and is not eliminated—these salts produce a progressive salification of the superficial beds and/or underground waters with the inconvenience this represents both on an environmental level and for the use of downstream river waters.

DETAILED DESCRIPTION OF THE INVENTION

This way, once the necessary studies and surveys have been performed on a laboratory level, as well as their validation on an industrial level in some concrete production plants, one proposes the following invention regarding dying processes with the direct recycling of dying baths already used without passing by any intermediate physico-chemical and/or biological depuration treatment: the textile dying process of cellulosic fibers and their blends and polyester and its blends with recycled dye baths, without performing any later depuration treatment, comes up only through a mechanical withholding filter of fibers and particles that may have been loosened from the textile substrate used in the dying process that preceded the next recycling.

The goal of said process is described in detail and both in the common aspects for cellulosic fibers and polyester and in the particular and specific aspects of the bath recomposition in the three cases mentioned:

Disperse Dyes—Polyester

Direct Dyes—Cellulosic Fiber

Reactive Dyes—Cellulosic Fibers

The direct recycling of dye baths applies to any kind of current dye machines usually used according to the way the textile substrate (fiber tuft thread or yarn and plane or knitted fabrics) presents itself when dye processes by depletion are carried out, and it suffices to connect the machine or machine bank carrying out the same dye processes to an additional tank, situated on a lower level, on the same level or on a level above the machines, with a capacity of $\Sigma_{i=1}^{n}$(o'qVi). The Vi is the individual volume of each machine, with the corresponding injection pumps (according to the status level of each machine and tank), allowing to send a residual bath of each machine to the tank, and from it to each machine for a new dye. Plus the coupling of a mechanical filter on the outlet of each machine or a single filter situated at the tank input, to which all conduits coming from the machines are connected.

The tank must include a thermometer next to the bath outlet channel, as well as a system allowing to easily extract samples from residual baths for their measurement and adjustment in the laboratory in the necessary cases and appropriate measurement systems of outflow and/or volumes that go in and out of the tank, both for an individual machine and a bank of machines that carries out the same process.

The studies and surveys carried out by the inventors of this proposed process have shown the sensitivity levels of each disperse dye, whereas its use in recycled dye baths is very particular vis-à-vis the variety of the distribution. This applies especially to the first recyclings, until a non-variable status can be achieved for its tinctorial parameters, in which it is possible to produce color deviations when these process types are started from a new bath, practically from the 5th to the 8th recycling, depending on the volume of the extracted bath, as the dye machine varies (80%-87.5%) as well as the volume of clean water to be added in each case for the following dye in a recycled bath (20%-12.5%)

For this reason, according to the color to be obtained in each dye and until acquiring enough experience with the usually used dyes (it is recommended the use of a trichromy with total compatibility on a wide range of intensity of the three dyes), it is necessary, especially in the 10 first recyclings, to confirm and adjust formulas in laboratory before starting a new industrial process, after being analyzed by U-Vis spectroscopy the residual concentrations of the dyes in the bath to be recycled, by taking a 5 ml sample from this bath and adding NN' Dymethyl-Formacide (5 ml) until a totally transparent solution is obtained and by comparison with the corresponding calibration straight lines for each dye in the three wave longitudes of maximum absorption of the specter achieved.

Once the new dye formula is adjusted according to the wanted color, the dying process takes place according to the following form:

The residual bath available volume is sent again to the dying machine, with the exact measurement, as appropriate to it. The volume of clean water that is lacking to reach the ratio of the wanted bath (minimum 10% of the total) is added, minus the volume that will be used to dissolve the auxiliary and dye products.

The amounts of auxiliary products (humectants, slider, anti-reducer, etc.) that were lacking are added, due to the volume of the added clean water.

It is added the amount of acetic acid (or of another organic acid usually used due to the added clean water and after checking the bath's pH.

It is added the amount of acetic acid (or another organic acid usually used due to the added clean water and the bath pH is checked.

The necessary amounts of dye are added according to the dying formula, previously discounted from the total volume necessary for dying.

The necessary amounts of dye are added according to the dye formula, previously discounted from the total volume necessary for dying.

After these operations, the temperature at the beginning of the procedure must be 60° C. at the most and, before starting the dying, the pH is checked once again and corrected if necessary.

In this following dying process, that is: heating gradient ($\Delta T/\Delta t$ ° C./min), the maximum temperature of the process and the threshold time and the cooling time must be appropriate, considering the intensity of the color to be achieved, the types of dyes to be used (low, medium or high diffusion) and the features of the PES own substrate (in fabrics, the final cooling may lead to fixed wrinkles).

The bath cooling may stop at 80° C. or 70° C. and the machine is emptied into the additional tank until preparation of the next dying with the recycled bath.

Later, rinses, washes, usual reducing wash in each case of polyester dying, whether normal or in microfiber, are carried out.

This process requires that the polyester textile substrate must be purged prior to its dying for, otherwise, according to the nature and amount of impurities, unrecoverable interferences may be produced when the dying baths are systematically recycled.

The recycling of residual baths of cellulosic fibers for dying with direct dyes is very similar in its features, precautions and valuations as the recycling with dispersed dyes, as indicted in section 2.1.

The main differences are as follows:

The cellulose substrate, in the case of natural fibers (cotton, linen, bamboo, etc.) must be previously whitened and, due to the solidity of direct dyes, one usually uses clear/medium hues, which must also be chemically bleached. In the case of artificial fibers (viscose, Lyocell, etc.), the case will be similar to those indicated for polyester.

The ratio of the recycled bath is notably lower than the availability in polyester, since, as they are hydrophilic materials, water withholding is superior (30%-20%).

The stationary state is achieved with the lowest number of recyclings (3 to 6), as the ratio of clean water added in each recycling is increased.

The proof and adjustment of formulas will be carried out in this case by taking 9 mL of initial residual bath and adding 1 mL of pyridine in order to achieve a totally transparent solution apt for its measurement by UV-Vis spectroscopy.

It is recommended the use of totally compatible trichromes of identical sensitivity to salt or to the temperature (B or C types, according to the SDC), whereas dyes of good equalization (A type) are not recommended as it is more difficult to reproduce the color.

Once the dying formula for the new bath to be recycled is adjusted, the process is carried out as follows:

The residual bath available volume is sent again to the dying machine, with its exact measurement.

The lacking volume is added with clean water, according to the wanted bath ratio, except the sum of the volumes to be added with auxiliary products, dyes and neutral electrolyte.

The lacking auxiliary products are added by being dosed according to the total clean water volume added.

The dyes are added and, according to the laboratory-adjusted formula, previously dissolved.

According to the types of dyes being used and their sensitivity level to salt, one may add the lacking electrolyte (according to the added total clean water), whether chlorine or sodium sulfate, also previously dissolved in the total clean water, at the beginning of the dying or at the end of the heating stage, according to the usually employed equalization control system.

After such operations, the dying process is started at a temperature that should not exceed 50° C., the bath is heated up to its boiling point, with the gradient appropriate to the dyes and the color intensity, and boiling and, later, cooling, are carried out like the usual processes in each concrete dying. After the machine is emptied into the auxiliary tank, the rinses and later treatments are made as usual, according to the type of used dye.

On both described processes, 2.1 and 2.2, the following elements are recycled:

A high percentage (70-90%) of dye water.

This same percentage of auxiliary products, neutral salts and acid.

A small percentage of dye that usually remains in the residual bath, since a 100% depletion is never achieved and depends on each type of dye and dying intensity, ranging from 5 to 20% of the initial dye.

The recycling of residual dye baths of cellulosic fibers with reactive dyes substantially differs from the two previously shown ones since, during the dying process, reactive dyes undergo a partial reaction of hydrolysis that makes impossible to recycle it in a later dying process. Not long ago, studies on recycling were focused on using hydrolized reactive dye as the dye for dying other textile fibers (polyamide, wool, silk), shown by the inventors of this patent that, even if it is not possible to recycle these dyes to dye cellulosic fibers, it also does not interfere in the result of the new dye with residual bath, to which must be added all reactive dye as if in the case of dying in clean water.

Even if the process is applicable to any kind of reactive dye, possible interferences will be smaller the bigger the yielding of the reaction, as it happens with bi- and trifunctional dyes.

In this process, the main advantage in the recycling of residual baths lies in the considerable savings of neutral salts (sodium chloride or sulfate), which spectacularly bears upon the non-salinity of cleansed residual waters for their flow-off, a critical aspect in certain countries and zones, where a clear risk of salinity occurs both in superficial river waters and in underground aquifers.

For this recycling process, it is not necessary to carry out the residual dye measurement, since it does not make part of the dye to be fixed to the following dye and, for this reason, the stages to be carried out are:

Previous adjustment of the pH of the residual bath at 7, with chlorhydric acid, as in the previous process the alkaline pH is finalized (approx. 9.5-10.5) as well as the calculation of the amount of sodium chloride produced in said neutralization.

Resending of the neutral residual bath to the dye machine and addition of the clean water volume necessary, according to the wanted bath ratio, minus the volume that will be used in dye dissolutions, auxiliary products, neutral electrolyte and alkali.

Addition of the lacking auxiliary products due to the total volume of the clean water added.

Start of the process, consisting of:

Addition of the previously dissolved dyes;

Addition of the electrolyte necessary to reach the nominal concentration, minus the sodium chloride produced in the neutralization of the previous residual bath; or perhaps:

Dosing of the dye and lacking neutral electrolyte as previously indicated, according to the linear, progressive or regressive curves.

Heating, or keeping the temperature on a neutral stage, as the usually followed procedure.

Addition of all usual amount of alkali, according to the dye and intensity of the dying, dosing according to the available systematics and installations.

Keeping the indicated time and temperatures in alkaline medium according to the dyes and intensities of the dying.

Also in this dying, the natural textile substrate should have been previously made non-crude (and whitened according to the color intensity) and in the initial recyclings it is advisable to check and make the adjustments to the laboratory formulation, considering the particular sensitivity of each dye and reactive group to the presence of the initial hydrolized dye in the bath.

Once the machine has been emptied into the auxiliary tank, one proceeds with rinsing and soaping the material—this is always recommended and a sine-qua-non for medium and intense color shades.

The inventors, in collaboration with Golden Química do Brasil, have studied and established trichromes of dyes and auxiliary products appropriate to cut down to a minimum the interferences by substances which, by addition of dyes (crystalline gels) and their own textile substrates, will accumulate in residual baths, until reaching a stationary state in which such concentrations remain practically constant, thus assuring maximum reproduction of the color, as well as the quality and solidity of the dyes in directly recycled residual baths.

At the same time, all details of the process that ensure its continuity and validity have been established, upon the use of recycled baths in a complete closed cycle system, which constitutes the usual work form of a textile dyer plant.

Despite the fact that the invention is detailed, it is important to understand that it does not limit its application to the details and stages described here. The invention is capable of other modalities or of being practiced or executed in a variety of ways. It must be understood that the terminology employed here is for the purpose of description and not limitation.

The invention claimed is:

1. A process for dyeing textiles using a recycled dye bath without carrying out any later depuration treatment, the dyeing process comprising:

filtering a used dye bath to mechanically withhold fibers and particles;

extracting a sample from the filtered dye bath;

analyzing the sample using UV-vis spectroscopy by comparing corresponding calibration curves for each dye in the sample;

pumping a measured volume of the residual dye bath into a dyeing machine;

diluting the measured volume of the filtered dye bath in the dyeing machine with an added volume of clean water to about an individual volume of the dyeing machine;

reconstituting the diluted dye bath in the dyeing machine with auxiliary and dye products in accordance to an analyzed result of the extracted sample;

measuring and adjusting a pH of the reconstituted dye bath;

using the reconstituted dye bath to dye textiles in the dyeing machine starting at an initial temperature which is ramped along a heating gradient up to a boiling point at a threshold time and then cooled down; and emptying out the used dye bath from the dyeing machine into an auxiliary tank.

2. The process of claim 1, further comprising adding either pyridine or N,N'-dimethylformamide to the extracted sample.

3. The process of claim 1, further comprising adding pyridine to the extracted sample.

4. The process of claim 1, further comprising rinsing and soaping the dyed textiles after using the step of using the reconstituted dye bath.

5. The process of claim 1 further comprising purging the textiles prior to using the reconstituted dye bath, wherein the textiles comprise polyester textiles.

6. The process of claim 1 further comprising whitening the textiles prior to using the reconstituted dye bath, wherein the textiles comprise cellulosic fiber textiles.

7. The process of claim 1, further comprising adding an electrolyte into the reconstituted dye bath.

8. The process of claim 7, wherein the electrolyte is selected from the group consisting of sodium chloride and sodium sulfate.

9. The process of claim 1, wherein adjusting the reconstituted dye bath to a pH of about 7.

10. The process of claim 9, wherein adjusting the pH of the reconstituted dye bath is comprises additions of chlorhydric acid or acetic acid.

11. The process of claim 1, wherein the measured volume of the residual dye bath pumped into a dyeing machine is about 80-87.5% by volume of the individual volume of the dyeing machine.

12. The process of claim 1, wherein the initial temperature is at most 60° C.

13. The process of claim 1, wherein the heating gradient is ramped to the boiling point of the reconstituted dye bath.

14. The process of claim 1, wherein disperse dyes are used for dyeing polyester textiles, and direct dyes or reactive dyes are used to dye cellulosic fiber textiles.

15. A process for dyeing textiles using a recycled dye bath without carrying out any later depuration treatment, the dyeing process comprising:

whitening cellulosic fiber textiles prior to dyeing;

filtering a used dye bath to mechanically withhold fibers and particles loosened from the textile substrate;

extracting a sample from the filtered dye bath;

adding pyridine or N,N'-dimethylformamide to the extracted sample;

analyzing the sample using UV-vis spectroscopy by comparing corresponding calibration curves for each dye in the sample;

pumping a measured volume of the residual dye bath into a dyeing machine;

diluting the measured volume of the filtered dye bath in the dyeing machine with an added volume of clean water to about the individual volume of the dyeing machine;

reconstituting the diluted dye bath in the dyeing machine with auxiliary and dye products in accordance to an analyzed result of the extracted sample;

adding an electrolyte into the reconstituted dye bath;

measuring and adjusting a pH of the reconstituted dye bath to a pH of about 7;

using the reconstituted dye bath to dye textiles in the dyeing machine starting at an initial temperature of at most 60° C. which is ramped along a heating gradient up to a boiling point at a threshold time and then cooled down;

emptying out the used dye bath from the dyeing machine into an auxiliary tank; and rinsing and soaping the dyed textiles after using the step of using the reconstituted dye bath.

16. The process of claim 15, wherein the electrolyte is selected from the group consisting of sodium chloride and sodium sulfate.

17. The process of claim 15, wherein adjusting the pH of the reconstituted dye bath is comprises additions of chlorhydric acid or acetic acid.

18. The process of claim 15, wherein the measured volume of the residual dye bath pumped into a dyeing machine is about 80-87.5% by volume of the individual volume of the dyeing machine.

19. The process of claim 15, wherein the heating gradient is ramped up to the boiling point of the reconstituted dye bath.

* * * * *